US007467425B2

(12) United States Patent
Harmes

(10) Patent No.: US 7,467,425 B2
(45) Date of Patent: Dec. 23, 2008

(54) DRAIN COVER AND ASSOCIATED METHODS

(76) Inventor: Brent E. Harmes, 101425 Overseas Hwy., #818, Key Largo, FL (US) 33037

( * ) Notice: Subject to any disclaimer, the term of this patent is extended or adjusted under 35 U.S.C. 154(b) by 689 days.

(21) Appl. No.: 11/079,959

(22) Filed: Mar. 15, 2005

(65) Prior Publication Data

US 2006/0207003 A1 Sep. 21, 2006

(51) Int. Cl.
*A47K 1/14* (2006.01)
*E03C 1/26* (2006.01)

(52) U.S. Cl. ..... 4/286; 4/292; 4/652

(58) Field of Classification Search ..... 4/286–292, 4/652; 401/6; D23/259–261
See application file for complete search history.

(56) References Cited

U.S. PATENT DOCUMENTS

| | | | | |
|---|---|---|---|---|
| 1,783,460 | A | 12/1930 | Brotz | |
| 2,317,707 | A * | 4/1943 | Yavitch | 4/292 |
| 2,890,463 | A * | 6/1959 | Young | 4/287 |
| 3,321,080 | A | 5/1967 | Pansini et al. | |
| 3,702,013 | A * | 11/1972 | Gebert | 4/288 |
| 3,982,289 | A | 9/1976 | Robbins | 4/292 |
| 4,944,398 | A | 7/1990 | Gatt | 206/507 |
| 5,271,108 | A | 12/1993 | Wicke | 4/292 |
| 5,830,350 | A * | 11/1998 | Voss et al. | 4/290 |
| 6,108,828 | A | 8/2000 | Cheng | 4/286 |
| 6,145,136 | A | 11/2000 | Parisi et al. | 4/290 |
| 7,032,253 | B2 * | 4/2006 | Colpitts et al. | 4/287 |
| 7,070,351 | B2 * | 7/2006 | Cooper et al. | 401/6 |
| 2004/0107489 | A1 | 6/2004 | Caterina | 4/290 |

OTHER PUBLICATIONS

Clever Clean Hair Catcher made by Creative Bath Products, Inc. and purchased from Linens-N-Things.

* cited by examiner

*Primary Examiner*—Tuan N Nguyen
(74) *Attorney, Agent, or Firm*—Mark R. Malek, Esq.; Zies Widerman Sutch & Malek

(57) ABSTRACT

A drain cover may include a base, a medial member extending upwardly from the base, an outer peripheral sidewall extending upwardly from the base, and a collar extending outwardly from the outer peripheral sidewall. The base may have a medial portion, an outer peripheral portion, a first passageway formed in the medial portion, and a plurality of second passageways formed between the medial portion and the outer peripheral portion. The medial member may have a grip portion. The collar may extend outwardly from the top of the outer peripheral sidewall.

20 Claims, 7 Drawing Sheets

FIG. 1.
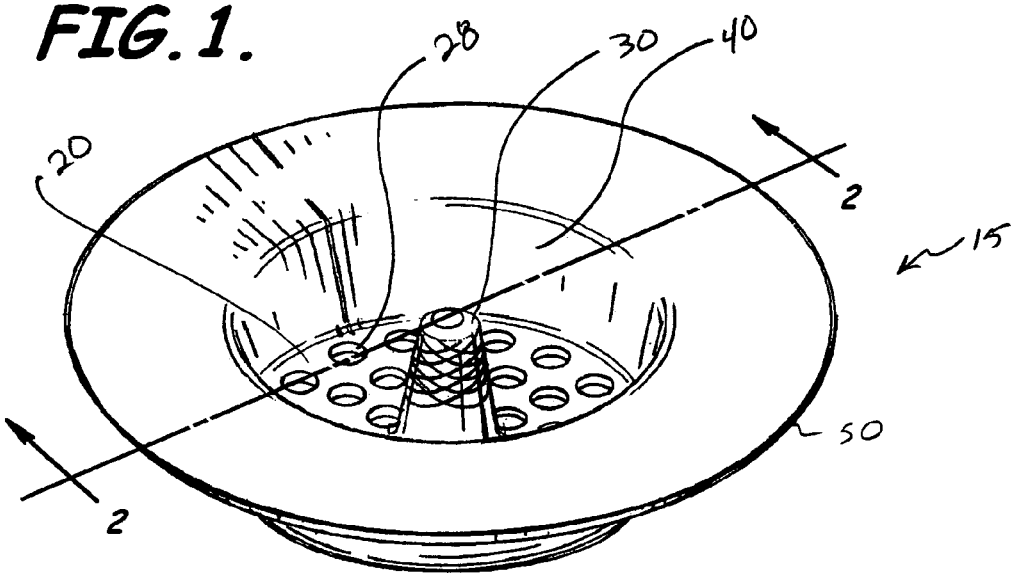
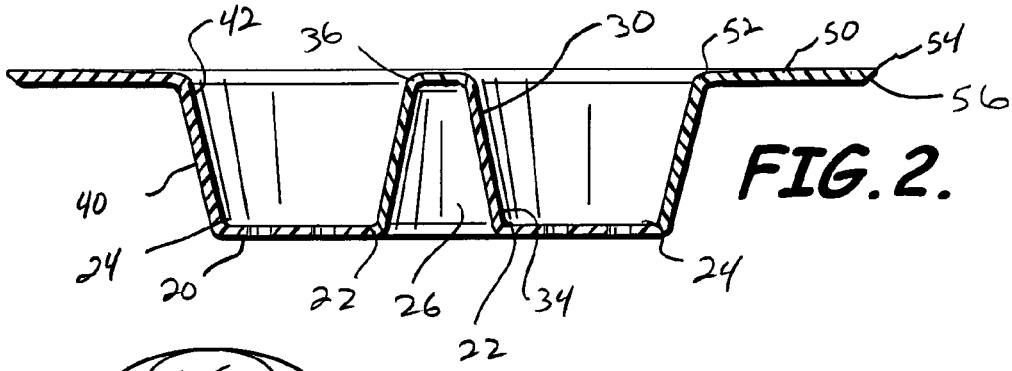
FIG. 2.
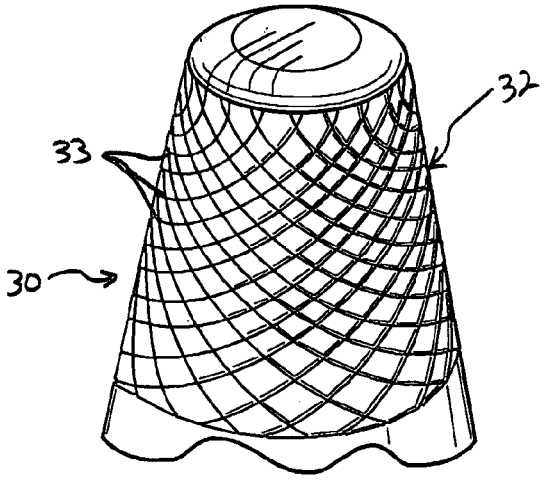
FIG. 3.
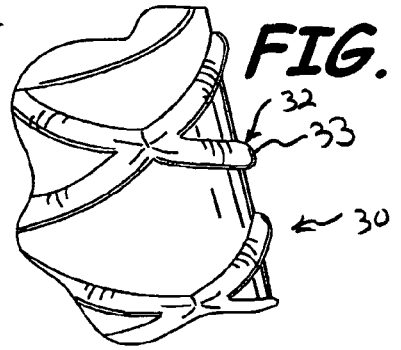
FIG. 3A.
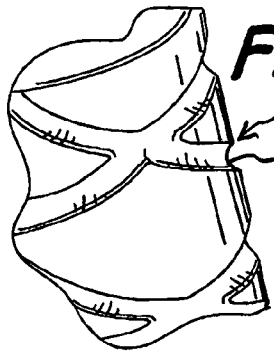
FIG. 3B.

B
40
30
20
50
5
15
56

DRAIN COVER AND ASSOCIATED METHODS

FIELD OF THE INVENTION

The present invention relates to the field of drain covers and, more specifically, to drain covers for use with sinks to prevent entry of debris into a drain, and related methods.

BACKGROUND OF THE INVENTION

Drain covers are typically used to prevent the entry of debris into a sink drain, but allow water to drain from the sink. A typical drain cover is disclosed in U.S. Pat. No. 3,321,080 to Pansini et al. This drain cover is used to cover a drain of a swimming pool to prevent leaves from entering the swimming pool drain.

The Pansini et al. drain cover includes a base having a plurality of passageways formed therein, an angled sidewall, an outer radial rib, and a loop member to allow a user to remove the drain cover from the swimming pool drain. The drain cover, however, is likely rigid to withstand water pressure in a pool, and the loop member may interfere with any activity adjacent the swimming pool drain, i.e., cleaning.

A drain cover for prohibiting debris from entering a sink drain is disclosed in U.S. Pat. No. 5,271,108 to Wicke. The drain cover includes an annular sleeve made of flexible material, and a plurality of outwardly flared projections to prevent entry of tableware to the sink drain. The drain cover also includes a separate gasket that is positioned between the annular sleeve and the drain cover. The separate sleeve and gasket of this drain cover, however, may be somewhat complicated to use.

A drain cover by Creative Bath Products, Inc. sold under the trade name "Clever Clean Hair Catcher" includes a base and a stepped medial member that extends upwardly from a medial portion of the base to be positioned over a shower or sink drain to prevent the entry of hair into the shower or sink drain. It may be difficult, however, for a user to grasp any portion of this cover to remove it from over the drain.

Another type of drain cover used for prohibiting debris from entering a sink drain is disclosed in U.S. Published Patent Application No. 2004/0107489 by Caterina. This drain cover includes a base and a sidewall extending upwardly from the base. A medial member extends upwardly from the base and may be gripped by the fingers of a user. The drain cover, however, will likely be slippery when wet, and a user may be unsuccessful in gripping the medial member.

SUMMARY OF THE INVENTION

In view of the foregoing background, it is therefore an object of the present invention to provide a drain cover that may be readily positioned over a drain and removed by a user.

It is also an object of the present invention to provide a drain cover that forms a seal when positioned over a drain.

It is further an object of the present invention to provide a drain cover that may be personalized with indicia.

These and other objects, features, and advantages in accordance with the present invention are provided by a drain cover that preferably has a base, a medial member, an outer peripheral sidewall, and a collar. More specifically, the base may have a medial portion, an outer peripheral portion, a first passageway formed in the medial portion, and a plurality of second passageways formed between the medial portion and the outer peripheral portion.

The medial member may extend upwardly from the medial portion of the base to overlie the first passageway. Further, the medial member may have a grip portion, which advantageously allows a user to readily position and remove the drain cover from over a drain.

The outer peripheral sidewall may extend upwardly from the outer peripheral portion of the base. The collar may extend outwardly from a top portion of the outer peripheral sidewall. More specifically, the collar may include an inner peripheral portion adjacent the top of the outer peripheral sidewall, and an outer peripheral portion opposite the inner peripheral portion.

The collar may extend outwardly from the top portion of the outer peripheral sidewall substantially parallel with the base. The collar may advantageously enhance a seal between the drain cover and a surface adjacent the drain cover when the drain cover is positioned over the drain. The outer peripheral portion of the collar may have an angled edge.

The grip portion may be defined by a plurality of grip members connected to and extending outwardly from a medial member, or by a plurality of recesses formed in the medial member.

The drain cover may also include a lifting member connected to the collar. The lifting member may advantageously enhance the ability of a user to readily position and remove the drain cover from over a drain.

The base, the medial member, the outer peripheral sidewall, the collar, and the lifting member may be integrally formed as a monolithic unit. The drain cover may also include indicia positioned on at least one of the base, the medial member, the outer peripheral sidewall, and the collar.

A method aspect of the present invention is for using the drain cover. The method may include positioning the drain cover over a drain, and removing the drain cover from the drain by engaging at least one of a grip portion on the medial member, at least one lifting member connected to the collar, and an angled edge of an outer peripheral portion of the collar.

BRIEF DESCRIPTION OF THE DRAWINGS

FIG. 1 is a perspective view of a drain cover according to the present invention.

FIG. 2 is cross sectional view of the drain cover shown in FIG. 1 taken through line 2-2.

FIG. 3 is a partial perspective view of a medial member of the drain cover illustrated in FIG. 1.

FIG. 3A is a partial perspective view of a grip portion of the medial member of the drain cover being defined by grip members according to the present invention.

FIG. 3B is a partial perspective view of another grip portion of the medial member of the drain cover being defined by grip recesses according to the present invention.

DETAILED DESCRIPTION OF THE PREFERRED EMBODIMENTS

Figures 4, 5, 6:
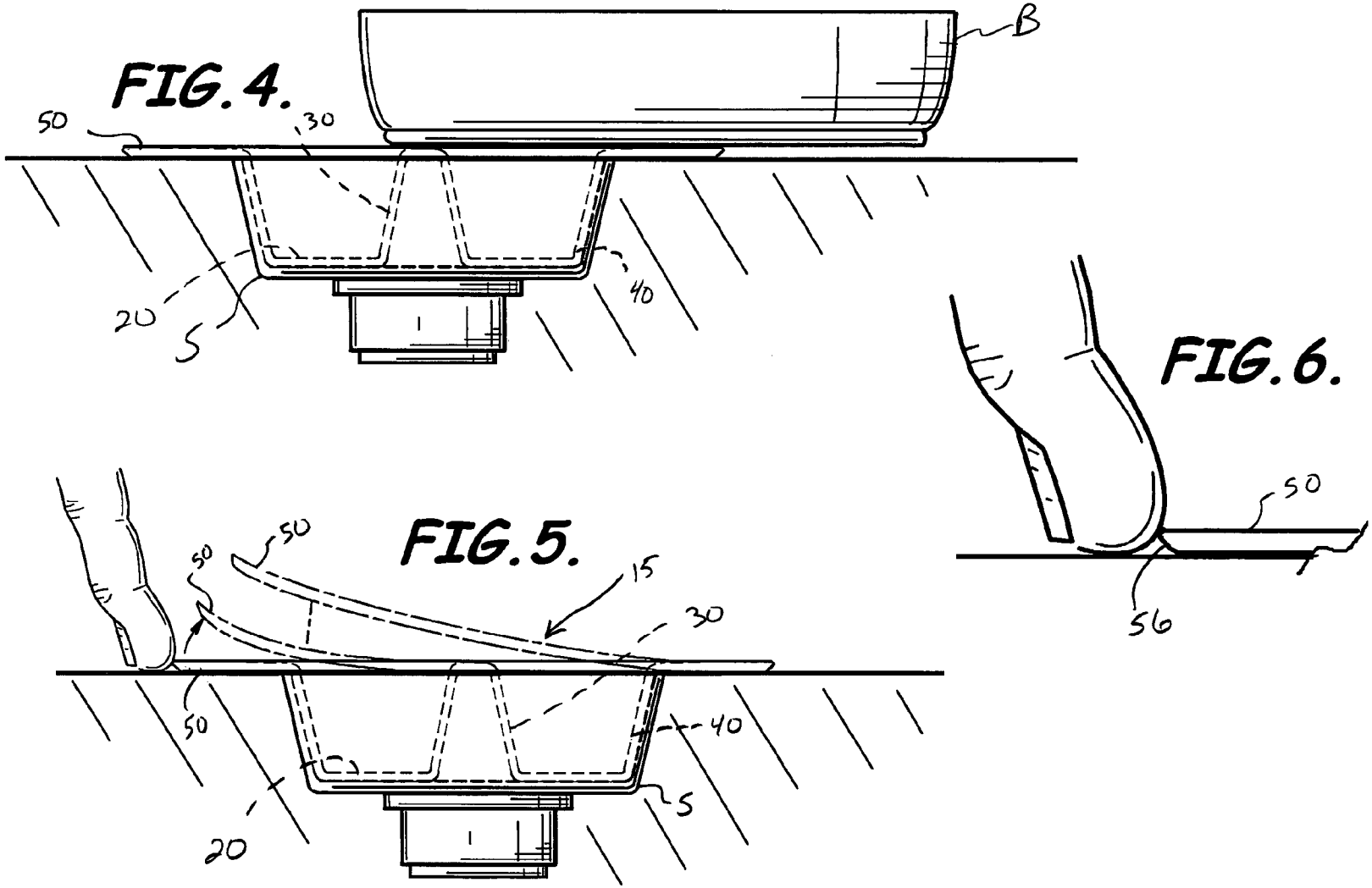
FIG. 4 is a side elevational view of the drain cover illustrated in FIG. 1 being positioned over a drain and having an article positioned thereon.
FIG. 5 is a side elevational view of a drain cover illustrated in FIG. 1 and being removed from a drain.
FIG. 6 is a partial side elevational view of the drain cover shown in FIG. 5 and having a user's finger positioned adjacent an outer peripheral portion thereof to remove the drain cover from the drain.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple notations are used to indicate similar elements in alternate embodiments.

Referring initially to FIGS. 1-3, a drain cover 15 according to the present invention is now described. The drain cover 15 illustratively comprises a base 20 having a medial portion 22, an outer peripheral portion 24, a first passageway 26 formed in the medial portion, and a plurality of second passageways 28 formed between the medial portion and the outer peripheral portion. The first passageway 26 is preferably larger than each of the second passageways 28. The plurality of second passageways 28 advantageously allows water to be drained from a sink, for example, when the drain cover 15 is positioned over a sink drain S, and prevents debris from entering the sink drain.

Those skilled in the art will appreciate that the plurality of second passageways 28 may be suitably sized to allow water to drain from the sink and prevent debris from entering the sink drain. Those skilled in the art will also appreciate that although a sink drain S is discussed throughout this disclosure, the drain cover 15 of the present invention may be used with any type of drain, e.g., a shower drain.

The drain cover 15 also preferably includes a medial member 30 that extends upwardly from the medial portion 22 of the base 20. More specifically, the medial member 30 preferably overlies the first passageway 26. The medial member 30 has a lower portion 34 adjacent the base 20, and an upper portion 36 opposite the lower portion. An opening may be formed in the upper portion 36 of the medial member 30.

The medial member 30 may also comprise a grip portion 32 adjacent the upper portion 36 thereof. As perhaps best illustrated in FIG. 3A, a first embodiment of the grip portion 32 may include a plurality of grip members 33 connected to and extending outwardly from the medial member 30.

A second embodiment of the grip portion 32' is illustrated in FIG. 3B. The second embodiment of the grip portion 32' illustratively includes a plurality of grip recesses 33' formed in the upper portion 36' of the medial member 30'. The grip portion 32, 32' advantageously enhances a user's ability to readily grasp the medial member 30, 30' of the drain cover 15, 15' to thereby remove the drain cover from a sink drain S as desired. This may be especially helpful when the drain cover 15, 15' is wet.

The drain cover 15 also comprises an outer peripheral sidewall 40 that extends upwardly from the outer peripheral portion 24 of the base 20. The outer peripheral sidewall 40 may illustratively extend upwardly at an angle from the base 20. Those skilled in the art will appreciate that the outer peripheral sidewall 40 may extend upwardly from the outer peripheral portion 24 of the base 20 at any angle, but preferably extends at an angle that may be similar to the contour of the sidewalls of a typical sink drain S.

The drain cover 15 also includes a collar 50 that extends outwardly from a top portion 42 of the outer peripheral sidewall 40. The collar 50 includes an inner peripheral portion 52 adjacent the top portion 42 of the outer peripheral sidewall 40, and an outer peripheral portion 54 opposite the inner peripheral portion.

The collar 50 may extend outwardly from the top portion 42 of the outer peripheral sidewall 40 substantially parallel with the base 20. Those skilled in the art, however, will appreciate that the collar 50 may extend at any angle. Rather, it is preferable that the collar 50 extends outwardly from the top portion 42 of the outer peripheral sidewall 40 to have a shape that contours a portion of a sink adjacent the sink drain S.

Referring now additionally to FIGS. 4-6, additional aspects of the collar 50 of the drain cover 15 are now described in greater detail. The outer peripheral portion 54 of the collar 50 may preferably have an angled edge 56. Although the angled edge 56 is illustrated as being angled inwardly, toward the outer peripheral sidewall 40, those skilled in the art will appreciate that the angled edge may also be angled outwardly.

When the drain cover 15 is positioned over a sink drain S, as illustrated, for example, in FIG. 4, the collar 50 preferably engages a portion of the sink adjacent the sink drain. Accordingly, a seal is preferably formed between a bottom portion of the collar 50 and the portion of the sink adjacent the sink drain S. Further, when the drain cover 15 is positioned in the sink drain S, an article, such as a bowl B, for example, may be readily positioned in the sink without interference from the drain cover.

An inwardly extending angled edge 56 of the collar 50 may advantageously allow a user to readily engage the drain cover 15 to break the seal formed between the collar and the portion of the sink adjacent the sink drain S. This may be accomplished by engaging the inwardly extending angled edge 56 and lifting upwardly.

An outwardly extending angled edge (not shown) may advantageously enhance the seal formed between the bottom portion of the collar 50 and the portion of the sink adjacent the sink drain S. More specifically, an outwardly extending angled edge may advantageously prevent water in the sink from penetrating beneath the bottom portion of the collar 50, and possibly breaking the seal between the collar and the portion of the sink adjacent the sink drain S.

The medial member 30 preferably has an elevation substantially similar to the elevation of the collar 50. This advantageously provides a more level surface when the drain cover 15 is positioned in the sink drain S so that an article, such as a bowl B, as illustrated in FIG. 4, for example, positioned on the drain cover may be supported by surfaces having similar elevations, i.e., supported by the collar member 50 and the medial member 30 having substantially similar elevations.

Figure 7:
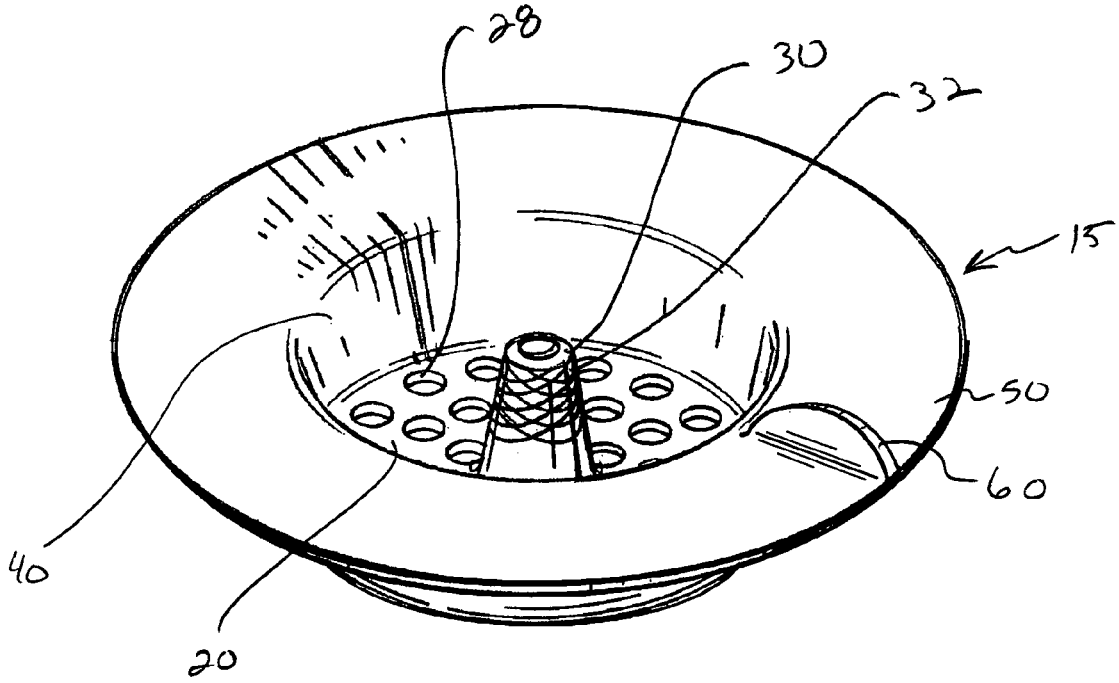
FIG. 7 is a perspective view of a drain cover including a lifting member according to the present invention.
Figure 8:
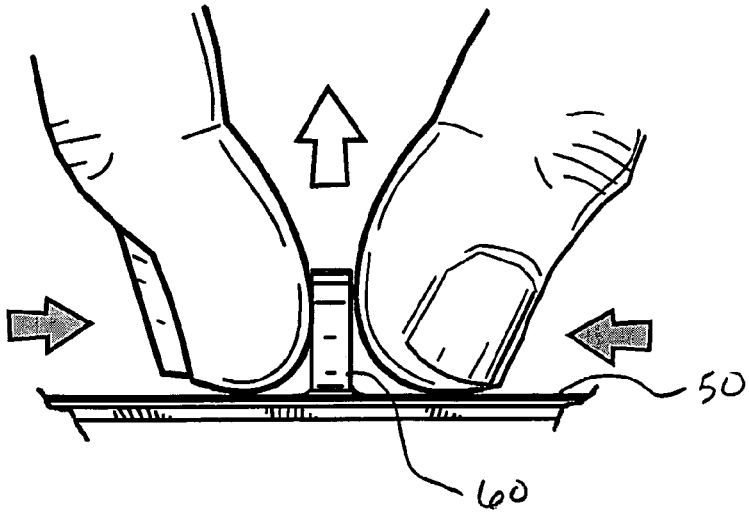
FIG. 8 is a side perspective view of the drain cover illustrated in FIG. 7 and having a lifting member being engaged by a user.

Referring now additionally to FIGS. 7-8, another aspect of the drain cover 15 is now described in greater detail. The drain cover 15 may illustratively include a lifting member 60 connected to the collar 50. More specifically, the lifting member 60 may be a knob that extends upwardly from a top portion of the collar 50. The lifting member 60 advantageously allows a user to readily break the seal formed between a bottom portion of the collar 50 and a portion of the sink adjacent the sink drain S by engaging the lifting member and lifting it upwardly as illustrated, for example, in FIG. 8.

The medial member 30 for a drain cover 15 having a lifting member 60 preferably has an elevation substantially similar to the elevation of the lifting member. Accordingly, a more level surface is advantageously provided when the drain cover 15 is positioned in the sink drain S so that an article positioned on the drain cover may be supported by surfaces having similar elevations, i.e., supported by the lifting member 60 and the medial member 30 having substantially similar elevations.

The lifting member 60 is illustrated as having an arcuate shape, but those skilled in the art will appreciate that the lifting member may have any shape suitable for allowing a user to engage the lifting member to remove the drain cover 15 from the sink drain S. Although a single lifting member 60 is illustrated in FIG. 7, those skilled in the art will appreciate that a plurality of lifting members may also be provided.

The base 20, the medial member 30, the outer peripheral sidewall 40, the collar 50, and the lifting member 60 may all be integrally formed as a monolithic unit. More particularly, the drain cover 15 may be formed in an injection molding process, a blow molding process, a thermal forming process, or any other process as understood by those skilled in the art. Accordingly, the manufacturing cost of the drain cover 15 may advantageously be low. The drain cover 15 is preferably made of a plastic material to provide flexibility. Those skilled in the art, however, will appreciate that the drain cover 15 may advantageously be made of any other type of material having similar properties.

Figure 9:
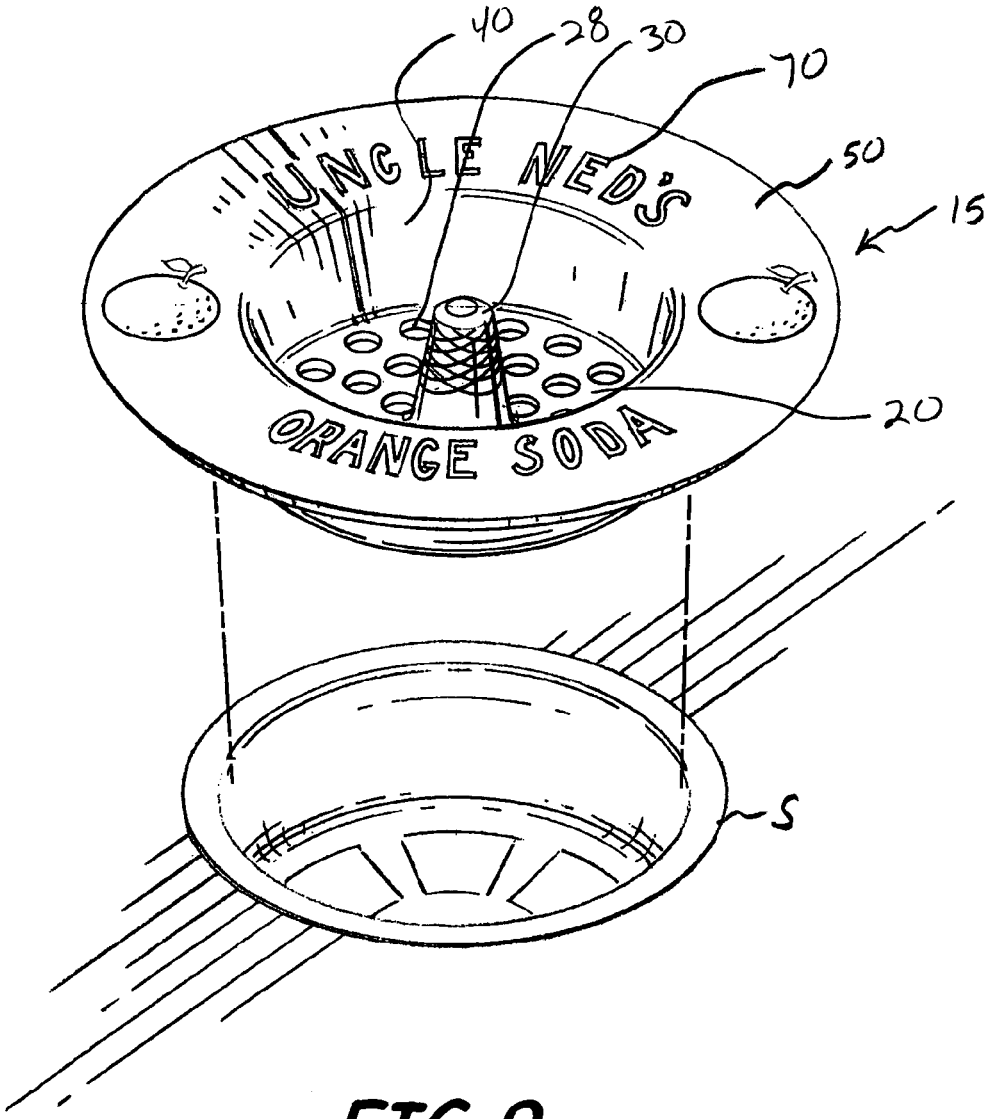
FIG. 9 is an environmental view of a drain cover having indicia positioned thereon according to the present invention, and being positioned over a drain.
Figure 10:
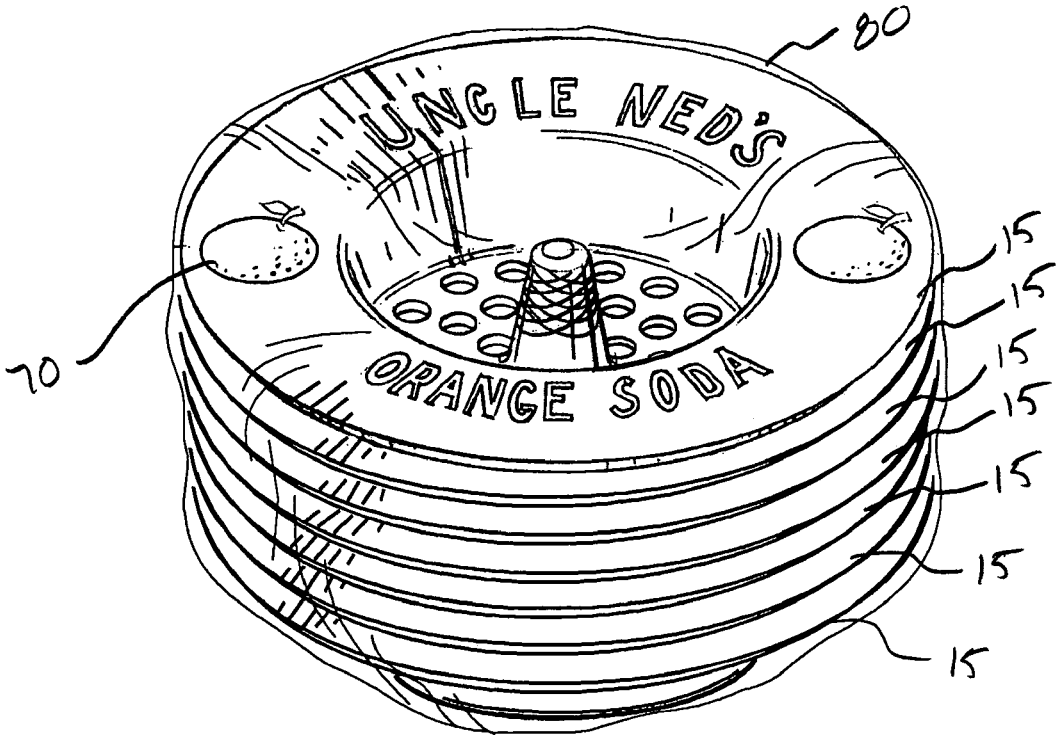
FIG. 10 is a perspective view of a plurality of the drain covers illustrated in FIG. 9 being configured in a stacked position, and wrapped.
Figure 11:
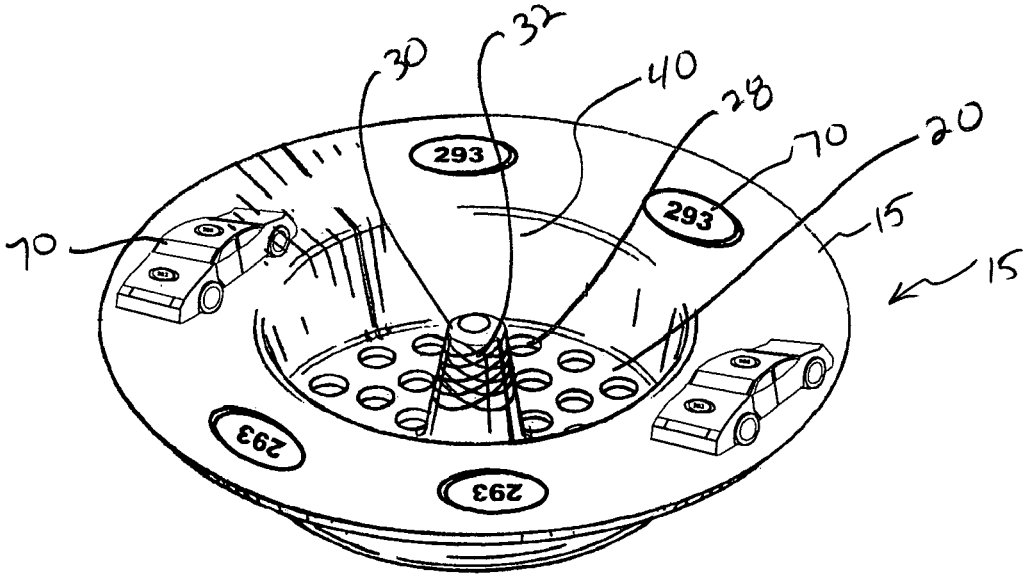
FIG. 11 is a perspective view of a drain cover having indicia positioned thereon according to the present invention.

Referring now additionally to FIGS. 9-12, still another aspect of the drain cover 15 is now described in greater detail. More specifically, the drain cover 15 may comprise indicia 70 positioned thereon. As illustrated in FIG. 9, the indicia 70 may be positioned on the collar 50 of the drain cover 15. The indicia 70 may, for example, be advertising indicia, or any other type of personalizing indicia, as understood by those skilled in the art. The indicia 70 may be any type of indicia, such as flat laying indicia, as illustrated in FIG. 9, or three-dimensional indicia, as illustrated in FIG. 11.

Figure 12:
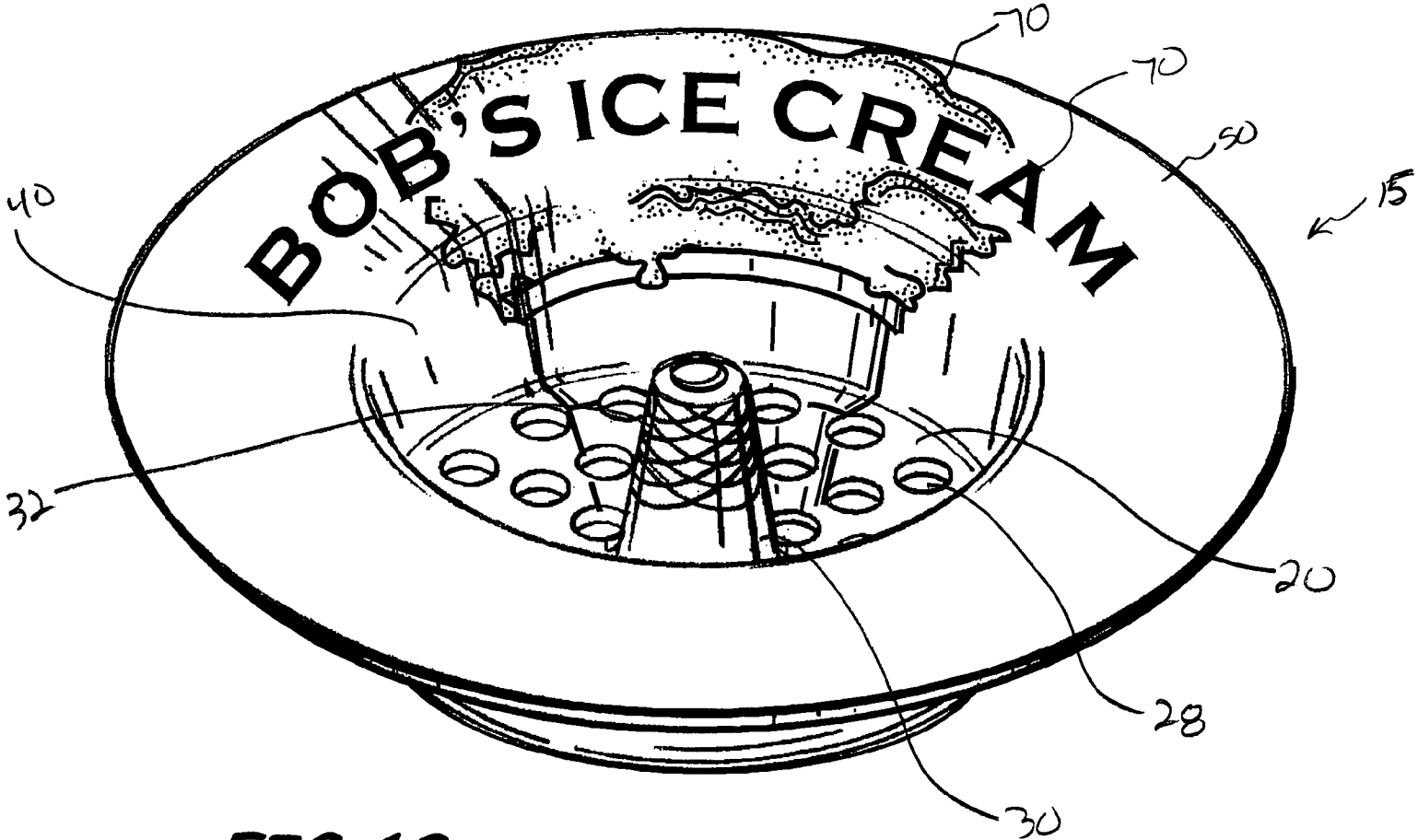
FIG. 12 is a perspective view of a drain cover having indicia positioned thereon according to the present invention.

As perhaps best illustrated in FIG. 12, the indicia 70 may be positioned on any portion of the drain cover 15. In other words, the indicia 70 may be positioned on the base 20, the medial member 30, the outer peripheral sidewall 40, and the collar 50. Placing the indicia 70 on multiple portions of the drain cover 15 advantageously enhances the appearance of the indicia.

The indicia 70 may be positioned on the drain cover 15 using any one of the number of different processes. For example, the indicia 70 may be painted onto the drain cover 15. Further, the indicia 70 may be provided by vinyl lettering that is applied to any portion of the drain cover 15. It is also contemplated that the indicia 70 may be provided by a picture that is laminated to any portion of the drain cover 15. Of course, those skilled in the art will appreciate that the indicia 70 may be provided in any other manner that is not specifically disclosed herein, but that accomplishes the goals of the present invention.

As perhaps best illustrated in FIG. 10, a plurality of the drain covers 15 may be positioned in a stacked configuration. More specifically, the first passageway 26 of a drain cover 15 may be positioned over the medial member 30 of another drain cover 15. Stacking a plurality of drain covers advantageously allows for a plurality of drain covers to be readily stored or shipped, for example. The plurality of stacked drain covers 15 may also be wrapped in a wrapping material 80 to protect the drain covers from foreign debris when being stored or shipped, for example.

Figure 13:
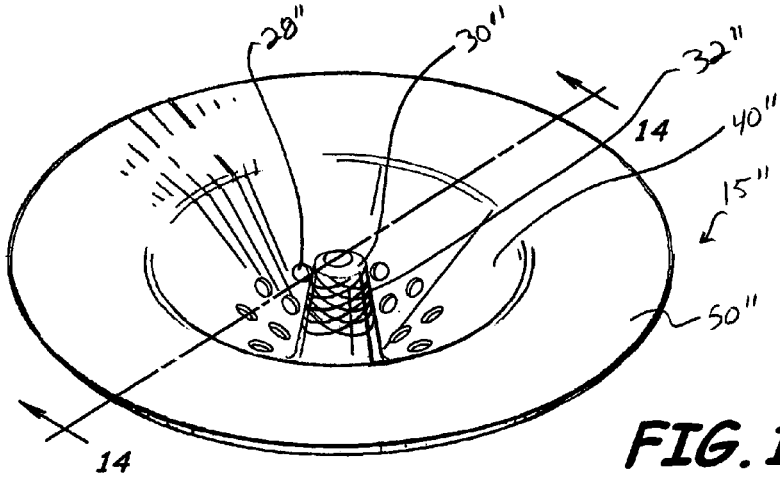
FIG. 13 is a perspective view of another embodiment of the drain cover according to the present invention.
Figure 14:
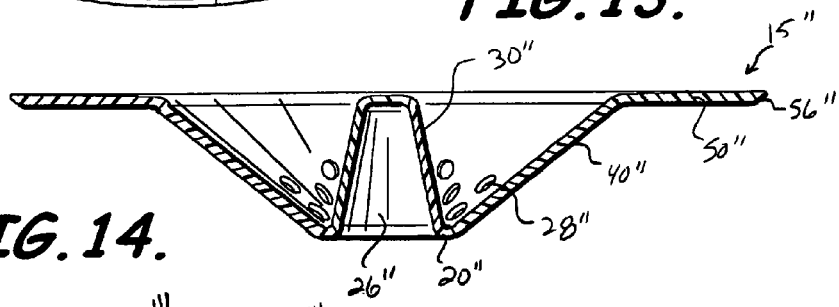
FIG. 14 is a cross sectional view of the drain cover shown in FIG. 13 taken through line 14-14.

Referring now more specifically to FIGS. 13-14, another embodiment of the drain cover 15" is now described is greater detail. In this embodiment of the drain cover 15", the base 20" is significantly smaller than the base of the first embodiment of the drain cover 15. Further, the outer peripheral sidewall 40" extends upwardly from the base 20" to the collar 50" at a more pronounced angle than in the first embodiment of the drain cover 15 to thereby provide the drain cover with a conical shape. Further, the plurality of second passageways 28" are illustratively formed in the outer peripheral sidewall 40". The other elements of this embodiment of the drain cover 15" are similar to those of the first embodiment of the drain cover 15, are labeled with double prime notation, and require no further discussion herein.

Figure 15:
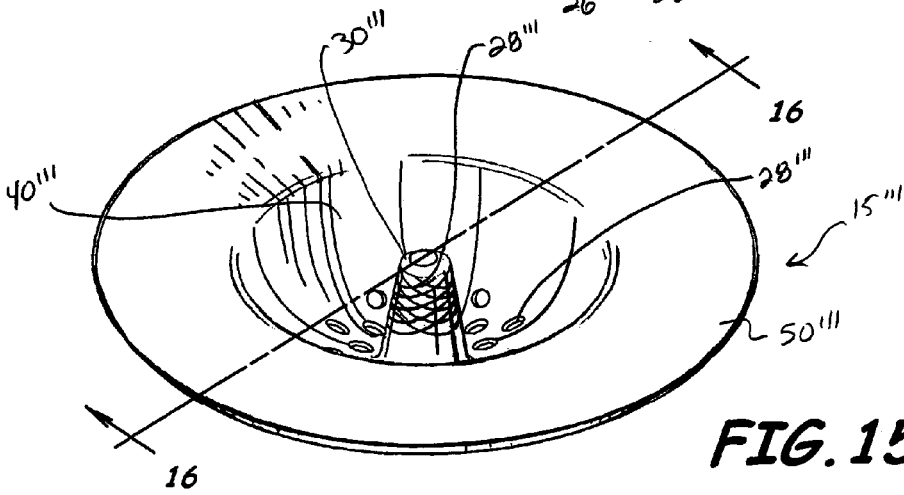
FIG. 15 is a perspective view of still another embodiment of the drain cover according to the present invention.
Figure 16:
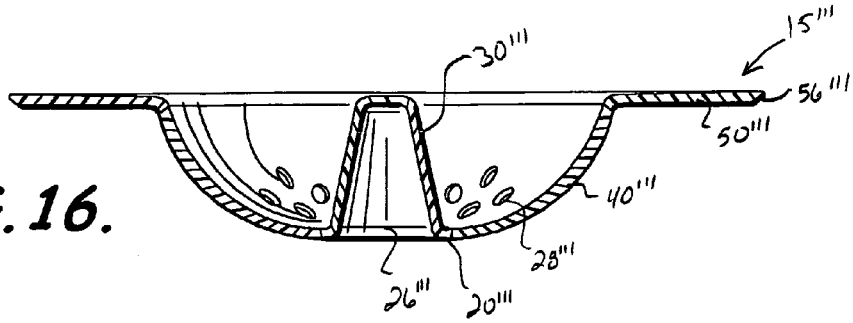
FIG. 16 is a cross sectional view of the drain cover shown in FIG. 15 taken through line 16-16.

Referring now additionally to FIGS. 15-16, still another embodiment of the drain cover 15''' is described in greater detail. In this embodiment of the drain cover 15''', the outer peripheral sidewall 40''' is illustratively curved to provide the drain cover with a curved shape. Again, the plurality of second passageways 28''' are preferably formed in the outer peripheral sidewall 40'–. The other elements of this embodiment of the drain cover 15''' are similar to those of the first embodiment of the drain cover 15, are labeled with triple prime notation, and require no further discussion herein.

A method aspect of the present invention is for using a drain cover 15. The method may include positioning the drain cover over a sink drain S. The method may also include removing the drain cover from the drain by engaging the grip portion 32 on the medial member 30. Alternately, the method may include removing the drain cover 15 from the drain by engaging the lifting member 60 connected to the collar 50, or by engaging the angled edge 56 of the outer peripheral portion 54 of the collar 50.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A drain cover comprising:

a base having a medial portion, an outer peripheral portion, a first passageway formed in the medial portion, and a plurality of second passageways formed between the medial portion and the outer peripheral portion, the first passageway being larger than each of the second passageways;

a medial member extending upwardly from the medial portion of said base to overlie the first passageway;

an outer peripheral sidewall extending upwardly from the outer peripheral portion of said base, said outer peripheral sidewall extending at a predetermined angle;

a collar extending outwardly from a top portion of said outer peripheral sidewall, and comprising an inner peripheral portion adjacent the top portion of the outer peripheral sidewall, and an outer peripheral portion opposite the inner peripheral portion;

indicia positioned on a surface portion of said collar, said indicia being positioned to extend substantially around the entire circumference of said collar so that said indicia is visible when said collar overlies a surface portion of a sink; and a grip portion carried by said medial member and positioned to extend from about a medial portion of said medial member to an upper portion of said medial member;

wherein said collar has an elevation substantially similar to an elevation of an upper portion of said medial member;

wherein the outer peripheral portion of said collar is defined by an angled edge that extends substantially the entire circumference of said collar.

2. A drain cover according to claim 1 wherein said collar extends outwardly from the top portion of said outer peripheral sidewall substantially parallel with said base.

3. A drain cover according to claim 1 wherein the grip portion is defined by a plurality of grip members connected to and extending outwardly from the medial member.

4. A drain cover according to claim 1 wherein the grip portion is defined by a plurality of grip recesses formed in the medial member.

5. A drain cover according to claim 1 further comprising at least one lifting member connected to said collar.

6. A drain cover according to claim 5 wherein said base, said medial member, said outer peripheral sidewall, said collar, and said lifting member are integrally formed as a monolithic unit.

7. A drain cover according to claim 1 wherein said is also positioned on at least one of said base, said medial member, and said outer peripheral sidewalls.

8. A drain cover comprising:

a base having a medial portion and an outer peripheral portion;

a medial member extending upwardly from the medial portion of said base;

an outer peripheral sidewall extending upwardly from the outer peripheral portion of said base;

a collar extending outwardly from a top portion of said outer peripheral sidewall, said collar having an elevation substantially similar to an elevation of an upper portion of said medial member;

indicia positioned on a surface portion of said collar to extend substantially around the entire circumference of said collar so that said indicia is visible when said collar overlies a surface portion of a sink; and at least one lifting member connected to an upper surface portion of said collar, said at least one lifting member extending substantially from an inner peripheral portion of said collar to an outer peripheral portion of said collar;

said base, said medial member, said outer peripheral sidewalls, and said collar being integrally formed as a monolithic unit.

9. A drain cover according to claim 8 wherein said collar extends outwardly from the top portion of said outer peripheral sidewall substantially parallel with said base.

10. A drain cover according to claim 8 wherein said base has a first passageway formed in the medial portion, and a plurality of second passageways formed between the medial portion and the outer peripheral portion, the first passageway being larger than each of the second passageways.

11. A drain cover according to claim 8 wherein the outer peripheral portion of said collar is defined by an angled edge.

12. A drain cover according to claim 8 wherein said medial member includes a grip portion positioned to extend from about a medial portion of said medial member to an upper portion of said medial member.

13. A drain cover according to claim 12 wherein said medial member has a grip portion defined by a plurality of grip members connected to and extending outwardly from the medial member.

14. A drain cover according to claim 12 wherein said medial member has a grip portion defined by a plurality of grip recesses formed in the medial member.

15. A method of using a drain cover comprising:

positioning the drain cover over a drain, the drain cover comprising a base, a medial member extending upwardly from a medial portion of the base, an outer peripheral sidewall extending upwardly from an outer peripheral portion of the base, a collar extending outwardly from a top portion of the outer peripheral sidewall and indicia positioned on a surface portion of the collar, the indicia being positioned to extend substantially around the entire circumference of the collar to that the indicia is visible when the collar overlies a surface portion of a sink, the collar having an elevation substantially similar to an elevation of an upper portion of the medial member, and also including a grip portion carried by the medial member and positioned to extend from about a medial portion of the medial member to an upper portion of the medial member; and removing the drain cover from the drain by engaging at least one of the grip portion on the medial member, at least one lifting member connected to the collar, and an angled edge of an outer peripheral portion of the collar.

16. A method according to claim 15 wherein the collar extends outwardly from the top portion of the outer peripheral sidewall substantially parallel with the base.

17. A method according to claim 15 wherein the grip portion is defined by a plurality of grip members connected to and extending outwardly from the medial member.

18. A method according to claim 15 wherein the grip portion is defined by a plurality of grip recesses formed in the medial member.

19. A method according to claim 15 wherein the base, the medial member, the outer peripheral sidewall, the collar, and the lifting member are integrally formed as a monolithic unit.

20. A method according to claim 15 wherein the at least one lifting member extends substantially from an inner peripheral portion of the collar to an outer peripheral portion of the collar, and wherein indicia is also positioned on at least one of the base, the medial member, the outer peripheral sidewalls.

* * * * *